United States Patent [19]

Cassidy et al.

[11] 4,182,971

[45] Jan. 8, 1980

[54] MERCURY-CONTAINING GLASS-CAPSULE DISPENSER FOR DISCHARGE LAMPS

[75] Inventors: Robert E. Cassidy, Seabrook, N.H.; Frank M. Latassa, Magnolia, Mass.; J. Arthur Roy, Danvers, Mass.; John G. Ray, Topsfield, Mass.

[73] Assignee: GTE Sylvania Incorporated, Stamford, Conn.

[21] Appl. No.: 922,944

[22] Filed: Jul. 10, 1978

[51] Int. Cl.[2] ..... H01J 61/28

[52] U.S. Cl. ..... 313/177

[58] Field of Search ..... 313/177

[56] References Cited

U.S. PATENT DOCUMENTS

| | | | |
|---|---|---|---|
| 2,991,387 | 7/1961 | McCauley | 313/177 X |
| 3,764,842 | 10/1973 | Ridders et al. | 313/177 |
| 3,794,402 | 2/1974 | Ridders et al. | 313/177 X |
| 4,056,750 | 11/1977 | Latassa | 313/177 |

*Primary Examiner*—Palmer C. Demeo

*Attorney, Agent, or Firm*—James Theodosopoulos

[57] ABSTRACT

A mount for an arc discharge lamp has a cathode thereon which is encircled by a disintegration shield. There is a gap in the shield and a mercury-containing glass capsule disposed proximate the gap. The capsule is supported on the shield by means of an axial wire in the capsule extending beyond both ends of the capsule and welded to the shield. A crack in the glass permits the mercury in the capsule to develop a vapor pressure in the lamp.

1 Claim, 2 Drawing Figures

MERCURY-CONTAINING GLASS-CAPSULE DISPENSER FOR DISCHARGE LAMPS

THE INVENTION

This invention is concerned with low pressure arc discharge lamps, particularly fluorescent lamps, which contain mercury. It is especially concerned with the means by which the mercury is introduced into the lamp.

The most commonly used method for introducing mercury into a lamp is a mechanical dispensing system. Mercury is dispensed by the action of a slotted plunger passing through a reservoir of mercury and into the closed exhaust chamber housing the lamp exhaust tube. The mercury falls through the exhaust tube into the lamp. This method lacks good control over the quantity of mercury dispensed into the lamp and requires costly periodic filling and cleaning of the mercury dispensers.

Another method of dispensing mercury, shown in U.S. Pat. Nos. 3,657,589 and 3,728,004, is to place inside the lamp a mercury compound that is inert under lamp processing conditions but can later be activated to release mercury. Disadvantageously, this method releases impurities, which then require special gettering. It also requires a relatively long time (20 to 30 seconds) to activate the mercury compound which does not readily lend itself to high speed machine production.

A third method involves the use of mercury containing capsules which are subsequently ruptured to release the mercury. Examples are in U.S. Pat. Nos. 2,288,253, 2,415,895, 3,300,037, 3,764,842, 3,794,402, 3,895,709, 3,913,999, and 3,983,439. These examples either require special heaters proximate the capsule or provide loose capsule particles within the lamp or dislodge phosphor coating upon capsule rupture or do not lend themselves to high speed machine production.

It is an object of this invention to provide a mercury dispenser in a discharge lamp which overcomes the disadvantages of prior art dispensers and is usable on high speed lamp manufacturing equipment.

U.S. Pat. No. 4,056,750, assigned to the same assignee as the instant application, shows a metal dispenser that also overcomes the prior art disadvantages. However, the instant invention uses a glass dispenser that is less expensive than said metal dispenser and simpler to handle. The glass dispenser comprises a sealed tubular glass capsule having an axial wire sealed to and protruding from both ends thereof. The wire, with the glass capsule thereon, is connected across a gap in the disintegration shield of a discharge lamp. The capsule contains a small predetermined amount of mercury. After the discharge lamp is sealed, the glass capsule is cracked in order to permit the mercury to develop a vapor pressure within the lamp.

In the drawing.

Figure 2:
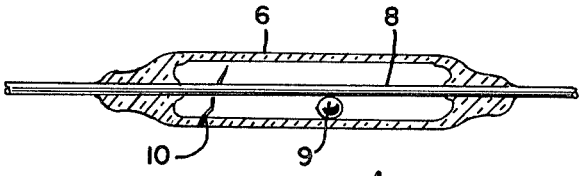
FIG. 2 is an enlarged perspective view of the capsule showing the glass capsule cracked.

As shown in the drawing, glass mount 1 of an arc discharge lamp has lead-in wires 2 embedded therein, cathode 3 being mounted on wires 2. Surrounding cathode 3 is a metal disintegration shield 5 which is supported by wire 4 embedded in mount 1. Shield 5 completely encircles cathode 3 except for a small gap 7 between the ends of shield 5. Bridging gap 7 is a mercury containing glass capsule 6 having an axial wire 8 extending through both ends of capsule 6. Wire 8 is welded to both sides of shield 5.

In one example, glass capsule 6 was 1 cm long and was made of type 0120 lead glass 90 mil diameter tubing having a wall thickness of 10 mils. Wire 8 was 20 mil nickel plated Dumet wire about 22 mm. long. Disposed within capsule 6 was a small ball 9 of mercury.

Capsule 6 was made by inserting wire 8 through an open-ended glass tube, mounting the wire plus tube in a glass lathe, and sealing one end of the tube using an oxygen-gas torch having a very small orifice. The seal was annealed in a box type oven at 450° C. for at least five minutes. The cooling time through the critical range of 450° C. was about fourteen minutes, an average of about 7° C. per minute. This cooling rate was sufficiently slow to remove excessive stresses from the glass metal seal.

Figure 1:
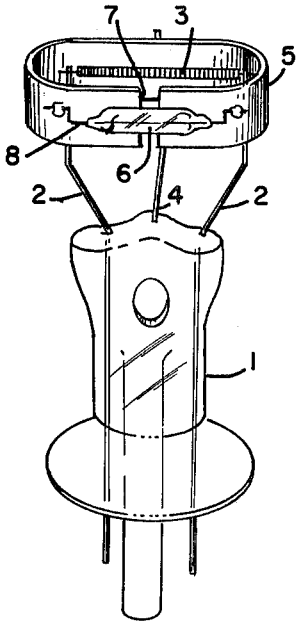
FIG. 1 is a perspective view of a discharge lamp mount embodying a mercury containing capsule in accordance with this invention.

Mercury was dispensed into the open end of the glass tube by means of a 30 gauge ½" long hyperdermic needle connected to an air operated pulse-type precision dispenser. The amount of mercury dispensed was controlled by controlling air pressure and pulse time. In the example, 16 mg of mercury was dispensed into the glass tube with a tolerance of only plus-or-minus 2 mg. The glass tub was then set vertically into a block having a hole to receive the wire at the sealed end. In this position, the mercury was resting at the bottom of the tube. The holding block was positioned in a cold water bath so that the water level was just above the mercury level. The cold water kept the mercury sufficiently cool so that it did not boil when the final seal was made. The open tube was then flushed with argon to displace the air in order to minimize mercury oxidation during the final seal. The open end of the glass tube was then sealed with a torch. After the final seal, capsule 6 was again put into the 450° C. box oven for annealing, as before. This procedure also checked for leaks, since mercury will vaporize at 450° C. Capsule 6 was then attached to shield 5 on mount 1 by welding each end of wire 8 to a respective side of shield 5. In order to prevent inducing stresses in the glass at the time of welding, it is desirable to bends the ends of wire 8 prior to welding. In one example, as shown in FIG. 1 each end had two approximatey right angle bends.

After mount 1 was mounted in a fluorescent lamp, and the lamp was sealed, glass capsule 6 was cracked by RF induction of shield 5 and wire 8 to generate current flow in wire 8. The wire heated much faster than the glass and the rapid expansion of the wire generated a sufficiently high circumferential tension in the glass to cause cracking. The glass generally cracked adjacent the seal and was generally a circumferential crack 10, as shown in FIG. 2. Three seconds of RF heating was generally sufficient to crack the glass. It is desirable to control the RF heat to just crack the glass without breaking it into chips, since loose glass chips inside the lamp could scratch the phosphor. Cracking of capsule 6 is adequate to establish the desired mercury vapor pressure within the lamp from mercury 9 in capsule 6.

We claim:

1. In an arc discharge lamp having a glass mount at one end with a cathode supported on the mount, the improvement comprising: a disintegration shield encircling the cathode except for a gap between the ends of the shield; a mercury-containing glass capsule disposed at about the gap region of the shield; an axial wire disposed in the capsule sealed to and protruding beyond the ends of the capsule, each end of the wire connected to a respective side of the shield, the shield and wire forming a closed loop in which an RF current can be induced, the ends of the wire having bends therein in order to prevent inducing stresses in the glass at the time said ends are connected to the shield: and a crack in the glass of the capsule sufficient to establish a mercury vapor pressure in the lamp due to the mercury in the capsule.

* * * * *